United States Patent [19]

Creighton

[11] Patent Number: 4,492,277

[45] Date of Patent: Jan. 8, 1985

[54] HYDRAULIC ENERGY DRILL BIT

[76] Inventor: Kenneth R. Creighton, 3238 Otterson Dr., Oklahoma City, Okla. 73112

[21] Appl. No.: 468,655

[22] Filed: Feb. 22, 1983

[51] Int. Cl.[3] ..... E21B 10/60

[52] U.S. Cl. ..... 175/329; 175/393

[58] Field of Search ..... 175/329, 393, 422, 410

[56] References Cited

U.S. PATENT DOCUMENTS

| | | | |
|---|---|---|---|
| Re. 25,319 | 1/1963 | Short | 175/329 |
| 3,357,507 | 12/1967 | Stewart | 175/410 |
| 4,323,130 | 4/1982 | Dennis | 175/329 |
| 4,350,215 | 9/1982 | Radtke | 175/329 |

FOREIGN PATENT DOCUMENTS

| | | | |
|---|---|---|---|
| 2717717 | 10/1978 | Fed. Rep. of Germany | 175/410 |

*Primary Examiner*—James A. Leppink
*Assistant Examiner*—Michael Starinsky
*Attorney, Agent, or Firm*—Harold E. Meier

[57] ABSTRACT

A drill bit for drilling a rock foundation is provided having a bit face matrix for supporting a plurality of cutters, the matrix having one or more fluid passages for discharging a fluid to flow over the bit face. To enhance the cleaning and cooling of the plurality of cutters, the bit face matrix includes a nozzle for restricting the surface fluid flow area between the foundation and the bit face to create a high velocity radial fluid flow across the entire surface area of the bit face matrix. This fluid flow prevents debris from accumulating on the plurality of cutters thus providing cooling thereof. In addition, improved fluid distribution is provided by a spiraling dams structure extending from the nozzle radially outward over substantially the entire bit face matrix. This structure enhances the flushing of the debris from the bit face by accelerating the debris and drilling fluid to the outer diameter of the bit.

16 Claims, 7 Drawing Figures

HYDRAULIC ENERGY DRILL BIT

TECHNICAL FIELD

The present invention relates to drill bits and more particularly, to a drill bit having a nozzle to provide a high velocity radial fluid flow across the surface of the bit for cleaning and cooling of the bit surface area during use.

BACKGROUND ART

Drill bits having a bit face supporting a plurality of synthetic diamond cutters are well known. These bits cut by scraping across a formation, thereby causing the rock to fail due to shear forces. In order to evacuate the debris broken up by the bit, a stream of drilling mud is directed downwardly through the drill bit and against the bottom of the formation. Prior art bits have also included grooves or recesses in the bit face to help effectuate the evacuation of debris. Although these structures have proven reasonably effective, they do not prevent the clogging of debris around the synthetic diamond cutters, especially those cutters near the outer periphery of the bit. When debris is not cleaned away from the surfaces of the cutters, the wear of the bit is increased. This problem is especially acute in drilling soft plastic formations, since cleaning these sticky formations from under the bit is extremely difficult. Further, although cleaning is not a problem when drilling in hard formations, during such drilling the cutters are subjected to high frictional heat. Therefore, there is a need for an improved drill bit structure that enhances the cleaning and cooling of the surface bit area.

SUMMARY OF THE INVENTION

A drill bit is provided comprising a bit face matrix having a plurality of synthetic diamond cutters mounted thereon. In accordance with the present invention, the cleaning and cooling of the bit surface area surrounding the synthetic diamond cutters is enhanced. More specifically, the bit includes a nozzle for restricting the surface fluid flow area between the foundation and the bit face matrix to create a high velocity radial fluid flow across the entire surface area of the bit face matrix. This fluid flow cleans the bit surface area by removing debris that could otherwise collect around the diamond cutter surfaces. In the preferred embodiment, the nozzle is formed by shaping the crest of the drill bit matrix in the form of a ring. In addition, the bit face matrix may include a spiraling dams structure in conjunction with the nozzle for providing better fluid distribution across the entire bit face. The spiraling dams structure serves to accelerate debris and drilling fluid to the outer diameter of the bit.

BRIEF DESCRIPTION OF THE DRAWINGS

A more complete understanding of the invention and its advantages will be apparent from the following Detailed Description taken in conjunction with the accompanying Drawings in which.

DETAILED DESCRIPTION

Figure 1:
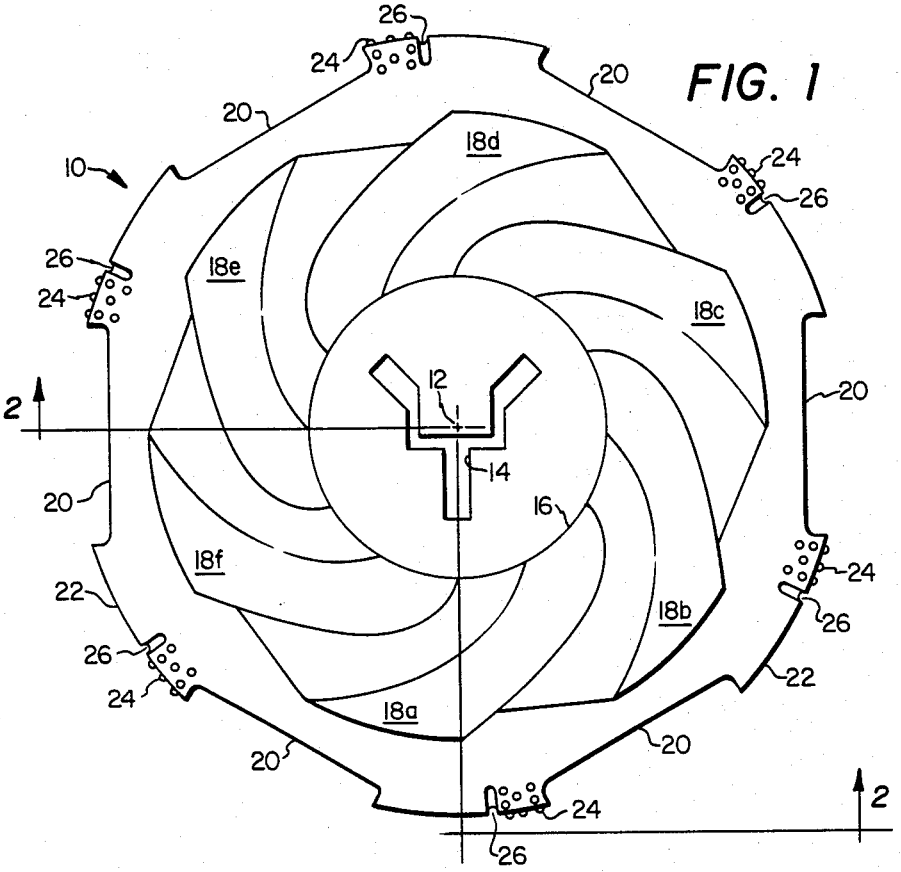
FIG. 1 is a plan view of the improved drill bit structure of the present invention with the plurality of synthetic diamond cutters removed.

With reference to FIG. 1, a plan view of the preferred structure of the improved drill bit 10 of the present invention is shown. Viewing the bit from the bit center 12 and moving radially outward, a "crow foot" fluid passage 14 is provided from which the drilling mud exits. The crest of the bit is shaped in the form of a ring to produce a ring or radius nozzle 16 that imparts a high velocity to the drilling mud flowing past the face of the bit, as will be described in more detail below. Adjacent the ring or radius nozzle 16, there is shown a spiraling dam structure 18 for improving fluid distribution across the bit face. The spiraling dam structure 18 includes a plurality of identical abutting sections 18*a–f*. A plurality of junk slots 20 are provided on the outer diameter 22 of the bit 10 for removal of debris. Groups of small diamonds 24 are also provided for gauge protection of the outer diameter. A secondary water course 26 is provided adjacent to each group of diamonds 24 for cleaning thereof. It should be noted that FIG. 1 discloses the drill bit of the present invention with the plurality of synthetic diamond cutters removed. Also, although a "crow foot" fluid passage 14 is shown, those skilled in the art will appreciate that other types of fluid passages, such as a standard rock bit nozzle, can be utilized.

Figure 2:
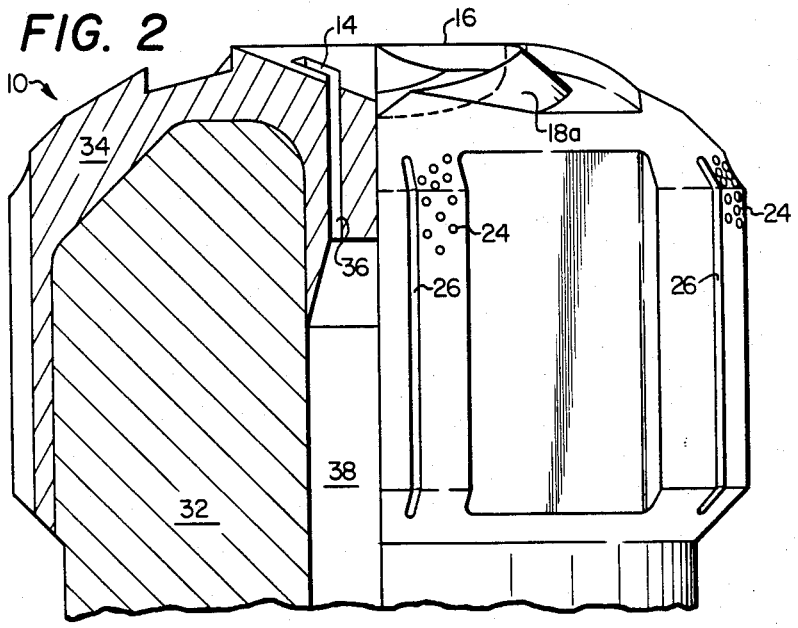
FIG. 2 is a projection of FIG. 1 and includes both a side view and a cutaway view of the improved drill bit with the plurality of synthetic diamond cutters removed.

FIG. 2 shows a projection of FIG. 1 including both a side view and a cutaway view of the drill bit 10 of the present invention. In FIGS. 1 and 2, like numerals are used for corresponding elements. Referring first to the side view, a full view of a junk slot 20, a diamond grouping 24, and a secondary water course 26 is shown. These structures are well known in the prior art. The side view also discloses a spiraling dam section 18*a* that extends from the ring or radius nozzle 16 radially outward until a change in the bit contour of the bit face. Thus, the ring or radius nozzle 16 is located intermediate fluid passage 14 and the spiraling dam structure 18.

The cutaway view of FIG. 2 shows details of the interior of the drill bit 10. In particular, the bit 10 comprises a shank portion 32 formed of steel. The bit face 34 of the bit 10 is formed over the shank 32 and preferably is a tungsten carbide matrix. The cutaway view shows a flow passage 36 that connects the fluid passage 14 to a main bore 38. As drilling mud is pumped to the face of the bit through bore 38, flow passage 36 and out fluid passage 14, it is forced past the ring nozzle 16 to produce a high velocity stream, as will be described below. This high velocity stream aids in flushing debris off of the drill bit face. As in FIG. 1, FIG. 2 does not disclose the placement of the plurality of synthetic diamond cutters.

Figure 3:
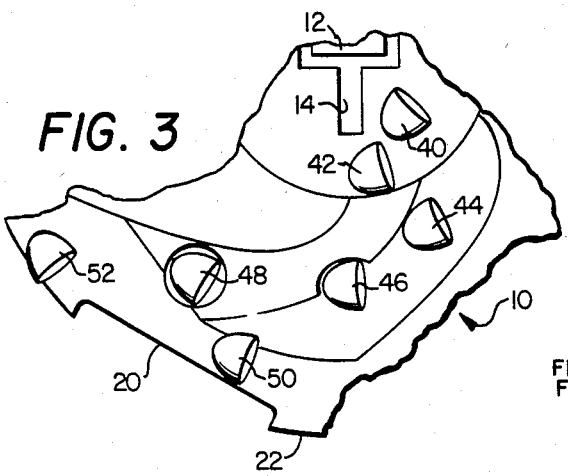
FIG. 3 is a plan view of one of the spiraling dam sections showing the preferred location of the plurality of synthetic diamond cutters relative to the bit center.
Figure 4:
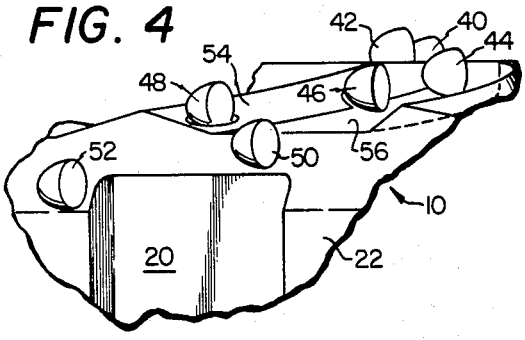
FIG. 4 is a projection of the structure seen in FIG. 3.

FIGS. 3 and 4 show a fragmentary plan view and a projection respectively of one of the dam sections 18*a* after the cutters have been mounted. Referring to FIGS. 3 and 4, a plurality of synthetic diamond cutters 40–52 are provided on the bit face matrix. FIG. 3 shows the preferred locations of the synthetic diamond cutters 40–52 relative to the bit center 12, the nozzle 16, the dam section 18*a*, and the bit outer diameter 22. More specifically, diamond cutters 40 and 42 are located within the ring nozzle 16. Diamond cutters 44, 46, and 48 are mounted on the spiraling dam section 18*a*. Diamond cutters 50 and 52 are located near the outer diameter 22 of the bit 10. As best seen in FIG. 4, each section of the spiraling dams structure 18 comprises a dam 54 and a connecting face 56 that connects the dam to a dam in the next abutting section. Each dam comprises approximately one-half of the sectioned area.

In accordance with the present invention, synthetic diamond cutters 40–52 comprise a wafer or plate of diamond bonded to a base material, preferably a tungsten carbide slug. These cutters were developed by General Electric Company and are commercially available under the trademarks STRATAPAX and COMPAX. The diamond wafer or plate is approximately 0.020 inches thick and 0.52 inches in diameter. The diamond is not a single crystal but rather a diamond-to-diamond, bonded, polycrystalline material. The diamond plate, bonded to a tungsten carbide slug having a conical base, is inserted in the drill bit face so that the diamond plate protrudes therefrom at the proper angle for cutting rock. Typically, the diamond cutters are mounted by press fitting the slugs into holes on the bit face. The cutters can also be attached by a stud, or by a direct brazing process onto a platform or carrier on the bit face matrix. It should be appreciated that, although STRATAPAX and COMPAX diamond cutters are preferred, other types of synthetic diamond cutters may also be used in the present invention.

Referring again to FIGS. 3 and 4, the operation of the present invention will now be described in detail. As the drill bit 10 rotates counterclockwise, the plurality of synthetic diamond cutters 40–52 cut the foundation by shearing the rock. The cut debris, in the form of appreciable size chips, is then removed from the drilled hole. In particular, drilling mud flows out of the fluid passage 14 to remove the cuttings from beneath the bit, these cuttings being accommodated by the junk slots 20. In prior drill bits the drilling mud exits one or more fluid passages, which may be of the "crow foot" type, and flows perpendicular to the horizontal bit axis; i.e., straight down toward the rock formation. This perpendicular flow is effective for removing debris from the synthetic diamond cutters nearest the location of the fluid passages. However, those diamond cutters located away from the fluid passage(s), i.e., the cutters on the outer periphery of the bit face when a "crow foot" passage is used, are typically not cleaned or cooled. This is because prior art designs don't adequately distribute the drilling mud over the entire bit face area. Cleaning of the cutters is especially difficult when drilling in soft or plastic formations. Further, although cleaning is not a problem when hard formations are drilled, the cutters are still subjected to high frictional heat, and thus require cooling. If the cutters are not cleaned and/or cooled, thermal damage may occur.

Figure 5:
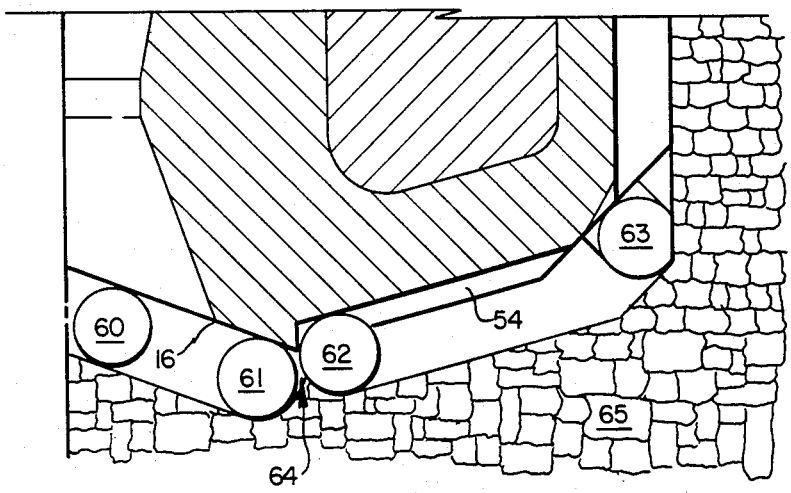
FIG. 5 is a cutaway view of an alternate embodiment of the hydraulic energy drill bit of the present invention showing the cutter profile formed in one bit rotation.

The preferred structure of the instant invention comprising the ring nozzle 16 and the spiraling dams structure 18 ameliorates the cleaning and cooling of the surface of the bit 10. In particular, as the drilling mud exits the fluid passage 14 the ring nozzle 16 restricts the surface fluid flow area between the rock foundation and the bit face matrix to create a high velocity radial fluid flow rather than a localized perpendicular flow relative to the horizontal bit axis. This high velocity is created due to the back pressure formed by the reduced flow area as best seen in FIG. 5 to be described below. The high velocity radial flow of the drilling mud provides greater hydraulic energy cleaning potential as compared with prior art structures such that debris does not accumulate even on the diamond cutters located on the outer periphery of the bit.

Fluid distribution across the bit face is enhanced by the spiraling dams structure 18 that extends from the ring nozzle 16 radially outward until a change in the bit contour. In operation, as fluid is ejected through the fluid passage 14 and across the nozzle 16, it is accelerated by the spiraling dam structure 18 as the bit rotates. More specifically, as fluid strikes the dams it is slung to the outside of the bit carrying debris as it moves. The spiraling dam structure 18 thus directs fluid across the entire bit face matrix to prevent debris from being accumulated on the synthetic diamond cutters 40–52.

Referring to FIG. 2, it can be seen that the height of the nozzle 16 is the same as the dam heights from the top of the nozzle out until the dams are truncated. The height of the nozzle should be between 1/16th of an inch to approximately one inch. When the lower limit is used, only slight acceleration of fluid is achieved and cleaning may be ineffective. In contradistinction, with the nozzle height near the upper limit, a very large flow restriction would occur, thus preventing enough fluid from flowing to keep the diamond cutters cool. In the preferred embodiment, the optimum nozzle height should fall between $\frac{1}{8}$ to $\frac{1}{2}$ inch. However, as the diamond cutter shapes and dimensions change, the nozzle height must also be varied accordingly. It should also be recognized that both the nozzle radius and the nozzle location can be varied. Further, multiple nozzles, for example a number of concentric rings across the bit face matrix, can be utilized.

Referring now to FIG. 5, an alternate embodiment of the drill bit is shown wherein the height of the dam 54 and the nozzle 16 are not the same. FIG. 5 shows a profile of the cut formed in one bit revolution by the cutters, only cutters 60–63 are shown. Note that FIG. 5 also shows how the nozzle creates the high velocity radial fluid flow. In particular, the nozzle forms a reduced cross-sectional area 64 with respect to the rock formation 65. The high velocity is created due to the back pressure formed by this reduced flow area.

Figure 6:
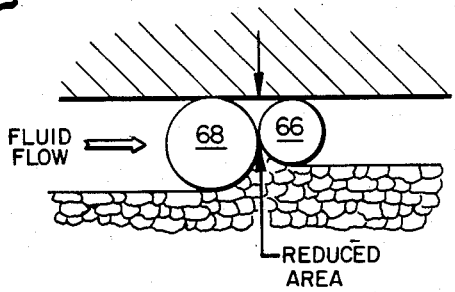
FIG. 6 discloses a schematic diagram of yet another alternate embodiment of the present invention wherein varying size synthetic diamond cutters are used to form a nozzle.

As noted above, a nozzle is formed whenever the surface fluid flow area between the rock formation and the bit fact matrix is restricted. Utilizing this fact, it can be seen that a nozzle is formed where different size synthetic diamond cutters are utilized. With reference to FIG. 6, diamond cutters 66 and 68 of varying diameters are provided. When such diamond cutters are mounted in close proximity to each other, a reduced cross sectional fluid flow area is formed to restrict fluid flow between the formation and the bit face. This restriction creates a back pressure that increases radial fluid velocity.

Figure 7:
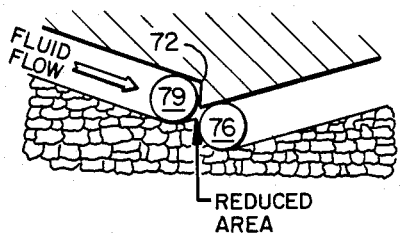
FIG. 7 discloses still another embodiment of the present invention having a different nozzle structure.

An alternate embodiment of the nozzle structure is seen in FIG. 7. In particular, the nozzle has an inverted step 72 such that a diamond cutter 74 is mounted lower than a diamond cutter 76 on the adjacent dam. This structure will also create a fluid flow restriction, thereby increasing fluid velocity.

A drill bit utilizing hydraulic energy for cleaning and cooling the bit face thereof has been provided as described above. In accordance with the instant invention, a ring nozzle is formed in the bit face matrix to restrict the surface fluid flow area between the rock foundation and the bit face matrix to impart a high velocity to the drilling mud flowing past the face of the bit. As drilling mud is pumped to the face of the bit, it is forced past the ring nozzle in a high velocity radial stream. This high velocity stream aids in flushing debris from the plurality of synthetic diamond cutters implanted into the bit face matrix, thus keeping the cutters cool. Fluid distribution across the drill bit matrix is improved by providing a spiraling dams structure that extends radially outward from the ring nozzle. As the drilling mud is ejected radially from the bit nozzle, it is forced against the dams as the bit rotates to enhance flushing of the drill bit matrix. This flushing keeps the cutters cleaner and cooler, thus extending the useful life of the bit.

The unique bit structure of the present invention provides several advantages over prior drill bits. Foremost, the nozzle provides high velocity radial fluid flow for greater cleaning and thus cooling potential while the spiraling dams structure assures that the high velocity fluid is distributed equally over the entire surface area of the bit face matrix. Since the cleaning fluid covers the entire bit surface, only an insignificant amount of erosion will occur around the nozzle area. Also, the radial fluid flow is advantageous since this is the direction that the debris must flow to be removed. As noted above, prior art fluid flow is perpendicular to the horizontal bit axis, thus requiring an expenditure of energy to change the direction of the flow path. Finally, the nozzle provides enough clearance between the rock foundation and the bit face matrix so that larger debris chips can be generated, therefore reducing drilling time.

Although the invention has been described in detail, it is to be clearly understood that the same is by way of illustration and example only and is not to be taken by way of limitation, the spirit and scope of the invention being limited only to the terms of the appended claims.

I claim:

1. A drill bit for drilling a foundation having a bit face matrix for supporting a plurality of cutters, the bit face matrix having one or more centrally-located fluid passages therein for discharging a fluid to flow over the bit face matrix, and at least one radius nozzle having the shape of an annular projection surrounding said fluid passages for restricting a surface fluid flow area between the foundation and the bit face matrix to create a high velocity radial fluid flow across the major surface area of the bit face matrix, said radius nozzle being located intermediate said fluid passages and the major surface area of said bit face matrix.

2. A drill bit as described in claim 1 wherein the radius nozzle is formed by shaping the crest of the drill bit matrix in an intermediate area in the form of an annular ring.

3. A drill bit as described in claim 2 further including a spiraling dams structure extending from the radius nozzle radially outward over substantially the entire bit face matrix for enhancing the distribution of the fluid over the surface area of the bit face matrix.

4. A drill bit as described in claim 3 wherein the spiraling dams structure comprises a plurality of similar abutting sections for directing the fluid, each of the sections including a dam and a connecting face.

5. A drill bit as described in claim 4 wherein, the height of the radius nozzle and the dams are essentially equal from the top of the nozzle outward until the dams are truncated.

6. A drill bit as described in claim 5 wherein the height of the radius nozzle is between $\frac{1}{8}$th and $\frac{1}{2}$ inch.

7. A drill bit as described in claim 3 wherein the cutters are formed of a synthetic diamond composition bonded to a tungsten carbide slug.

8. A drill bit as described in claim 3 further including a plurality of junk slots on its outer diameter for removing the debris.

9. A drill bit as described in claim 3 wherein said radius nozzle and said spiraling dams structure provide cooling of said plurality of cutters when said foundation is hard.

10. A drill bit as described in claim 3 wherein said radius nozzle and said spiraling dams structure prevent debris from accumulating on the plurality of cutters when said formation is soft.

11. A drill bit for drilling a foundation having a bit face matrix for supporting a plurality of cutters, the bit face matrix having one or more centrally-located fluid passages for discharging a fluid to flow over the bit face matrix, and at least one radius nozzle having the shape of an annular projection surrounding said fluid passages for restricting a surface fluid flow area between the foundation and the major surface area of the bit face matrix to create a high velocity radial fluid flow across the major surface area of the bit face matrix, the drill bit further including a spiralling dam structure extending from the radius nozzle radially and arcuately outward over substantially the major bit face matrix for enhancing the fluid distribution over the major surface area of the bit face matrix.

12. A drill bit as described in claim 11 wherein the spiralling dams structure comrises a plurality of identical abutting sections for directing the fluid, each of the sections including a dam and a connecting face.

13. A drill bit as described in claim 12 wherein the height of the radius nozzle and the dams are equal from the top of the nozzle outward until the dams are truncated.

14. A drill bit for drilling a foundation having a bit face matrix for supporting a plurality of cutters, the bit face matrix having at least one radius nozzle projecting from the bit face matrix in the form of an annular projection, one or more centrally-located fluid passages disposed interiorly of said nozzle for discharging a fluid to flow uniformly over the bit face matrix, and a spiralling dams structure comprising a series of wing-like arcuately-shaped projections extending from said radius nozzle for enhancing the fluid distribution over the major surface area of the bit face matrix.

15. A drill bit as described in claim 14 wherein the spiraling dams structure extends from the radius nozzle radially outward over substantially the entire bit face matrix.

16. A drill bit as described in claim 15 wherein the spiraling dams structure comprises a plurality of identical abutting sections for directing the fluid, each of the sections including a dam and a connecting face.

* * * * *

UNITED STATES PATENT AND TRADEMARK OFFICE

CERTIFICATE OF CORRECTION

PATENT NO. : 4,492,277
DATED : January 8, 1985
INVENTOR(S) : Kenneth R. Creighton It is certified that error appears in the above-identified patent and that said Letters Patent is hereby corrected as shown below:

Column 6, line 39, change "spiralling" to -- spiraling --;
change "comrises" to -- comprises --.

Signed and Sealed this

*Twenty-eighth* Day of *May 1985*

[SEAL]

*Attest:*

DONALD J. QUIGG

*Attesting Officer* *Acting Commissioner of Patents and Trademarks*